United States Patent [19]

Yoshida

[11] Patent Number: 4,601,107

[45] Date of Patent: Jul. 22, 1986

[54] SCALE BALANCING DEVICE IN UNIVERSAL PARALLEL RULER DEVICE

[76] Inventor: Yasutomo Yoshida, c/o Mutoh Industry Ltd., 3-I-3, Ikejiri, Setagaya-ku, Tokyo, Japan

[21] Appl. No.: 689,898

[22] Filed: Jan. 9, 1985

[51] Int. Cl.[4] ..... B43L 13/02

[52] U.S. Cl. ..... 33/438

[58] Field of Search ..... 33/430, 438, 495, 500

[56] References Cited

U.S. PATENT DOCUMENTS

| | | | |
|---|---|---|---|
| 3,871,101 | 3/1975 | Becattini et al. | 33/438 |
| 4,070,758 | 1/1978 | Watanabe | 33/438 |
| 4,495,708 | 1/1985 | Jopt et al. | 33/438 |

FOREIGN PATENT DOCUMENTS

| | | | |
|---|---|---|---|
| 2832484 | 2/1980 | Fed. Rep. of Germany | 33/430 |
| 3206383 | 4/1983 | Fed. Rep. of Germany | 33/438 |

*Primary Examiner*—Richard R. Stearns

*Attorney, Agent, or Firm*—Wenderoth, Lind & Ponack

[57] ABSTRACT

A scale balancing device for use in a universal parallel ruler device having a head, a spindle rotatably supported on a non-rotating part of the head, a scale mounting plate fixed to the lower spindle, a handle fixed to the upper spindle, and scales mounted on the scale mounting plate, the device has a first gear coaxially mounted on the spindle for rotation therewith, the weight of the scales exerting a torque on the first gear, a second gear rotatably mounted on a non-rotating part of the head and having a spring connected thereto for applying a torque to the second gear to rotate the second gear in a predetermined rotating direction, and a two-stage intermediate gear having a small gear and a large gear integrally connected and rotatably supported on a non-rotating part of the head, the second gear being in mesh with the small gear and the large gear being in mesh with the first gear, the ratio of the diameter of the first gear to the diameter of the large gear being substantially the same as the ratio of the diameter of the second gear to the diameter of the small gear, and the direction in which the torque is exerted on the first gear due to the weight of the scales being transmitted through the two-stage gear and exerted on the second gear in a direction opposite the predetermined direction and being substantially cancelled out by the torque on the second gear due to the spring.

1 Claim, 9 Drawing Figures

SCALE BALANCING DEVICE IN UNIVERSAL PARALLEL RULER DEVICE

BRIEF SUMMARY OF THE INVENTION

This invention relates to a scale balancing device in a universal parallel ruler device wherein a scale is caused to be set in a freely rotatable condition relative to a non-rotating member of a head on an inclinable drawing board whereby the scale is not rapidly rotated in a downward direction due to an inclination of the drawing board to maintain the scale in a stable and static condition.

Scale balancing devices in a universal parallel ruler device are available in various types, but the devices are classified roughly into a balance weight system and an eccentric cam system. The balance weight system is one in which the weight of a balance weight is caused to work in a direction opposite to the rotating direction on a member interlocked with the rotation of a scale in a downward direction to balance the scale by the action of the weight. A balancing device of this type is disclosed in the publications, for example, the Japanese Utility Model Publication No. 47-9478, Japanese Patent Publication No. 57-47040, Japanese Patent Publication No. 57-49399 and Japanese Patent Publication No. 58-4640. On the other hand, the eccentric cam system is one in which a spring is caused to work on an eccentric cam interlocked with the rotation of a scale, and a rotatory torque is generated on the eccentric cam by the elastic force of the spring in a direction opposite to the rotating direction of the scale due to the weight of the scale to balance the scale. A balancing device of the eccentric cam system type is disclosed in the Japanese Utility Model Publication No. 52-28605.

The balancing weight system type has a drawback, that for example, the weight becomes heavy due to the use of a balance weight and also, the manual rotation of the scale due to the inertia force of the balance weight becomes difficult. The eccentric cam system type has a drawback, that for example, a frictional force is generated on an elastic contact portion of the spring and the eccentric cam whereby the manual rotation of the scale to overcome the frictional force becomes difficult.

A primary object of this invention is to provide a scale balancing device which does not use a balance weight and an eccentric cam, and the scale is maintained in a balanced condition by connecting a spring member to a rotating member that rotates by interlocking with the scale, whereby the scale can be rotated by an easy manual operation.

Another object of this invention will be described in the following by referring to FIG. 4.

In a scale balancing device in which a spring 6 provided on a non-rotating member of a head is mounted on a rotating member 4 fixed to a spindle 9 connected to a scale 2, and the tensile force of the spring 6 is caused to act on an eccentric portion of the rotating member 4 to cancel out a torque of rotation of the spindle 9 due to the weight of the scale 2, when the scale 2 is at a position of almost +90 degrees, the tensile force of the spring 6 is set at zero, and the torque of rotation of the spindle 9 centering around a tubular member 8 due the weight of the scale 2 is set at zero. In the foregoing construction, when the rotating member 4 rotates so that the scale 2 reaches the zero degree position as shown in FIG. 4(*b*), a tensile load, for example, 5 kg, of the spring acts on the spindle 9. The torque of rotation exerted on the spindle 9 by the spring 6 becomes a maximum. Moreover, when the rotating member 4 is rotated in a clockwise rotating direction until the scale 2 reaches −90 degrees (refer to FIG. 4(*c*)), the spring force becomes 10 kg, and the rotatory torque exerted on the spindle 9 by the spring becomes zero. In this case, a load of 10 kg acts between the spindle 9 and the tubular member 8 due to the spring force. With this arrangement, the pressure load of the spindle 9 against the tubular member 8 becomes larger, which exerts an adverse influence on the durability of the head and the angular precision of the scale 2. However, as shown in FIGS. 4(*d*) to 4(*f*), in a construction in which a gear 11 is journaled rotatably on a non-rotating member 10 of the head, and is meshed with outer periphery of the rotating member 4, and the spring 6 is mounted on the eccentric portion of the gear 11, when the scale 2 is at +90 degrees, the spring force is set at zero and the torque of the gear 11 is set at zero, the spring force becomes 5 kg when the scale 2 is at the zero degree position, and the torque of the gear 11 becomes a maximum. As shown in FIG. 4(*f*), when the gear 11 is rotated until the scale 2 reaches −90 degrees, the spring force becomes 10 kg, but the rotatory torque of the gear 11 due to the spring force is zero. In this case, since only the rotatory torque of the gear 11 acts on the rotating member 4, the pressure load due to the spring 6 between the spindle 9 and the tubular member 8 is zero. As will be obvious from the foregoing description, when the rotating member connected to the scale is engaged with the gear provided on the non-rotating member of the head, and the spring force is arranged to act on the gear, the pressure load due to the spring force between the spindle 9 and the tubular member 8 can be decreased. However, when the diameter of the gear of the rotating member 4 is small, the force F acting on the rotating member 4 in the balancing direction must be made larger.

When the force F becomes large, the frictional force between the rotating member 4 and the gear 11 becomes large due to the force F. In order to make the force F smaller, it is necessary to make a diameter of the rotating member 4 as large as possible. But since the gear 11 must be rotated identically with the rotating member 4, the larger the diameter of the rotating member 4, the larger the diameter of the gear 11 is required to be, and as a result, the housing space for the gear 11 becomes large.

An object of this invention is to provide a scale balancing device which eliminates the foregoing problems, and to this end two stages of intermediate gears are interposed between the rotating member 4 and the gear 11, and thus, the diameter of the rotating member 4 can be made larger without enlarging a diameter of the gear 11.

DESCRIPTION OF THE PREFERRED EMBODIMENT

The construction of this invention will be described in detail with reference to an embodiment illustrated in the attached drawings.

Figure 1:
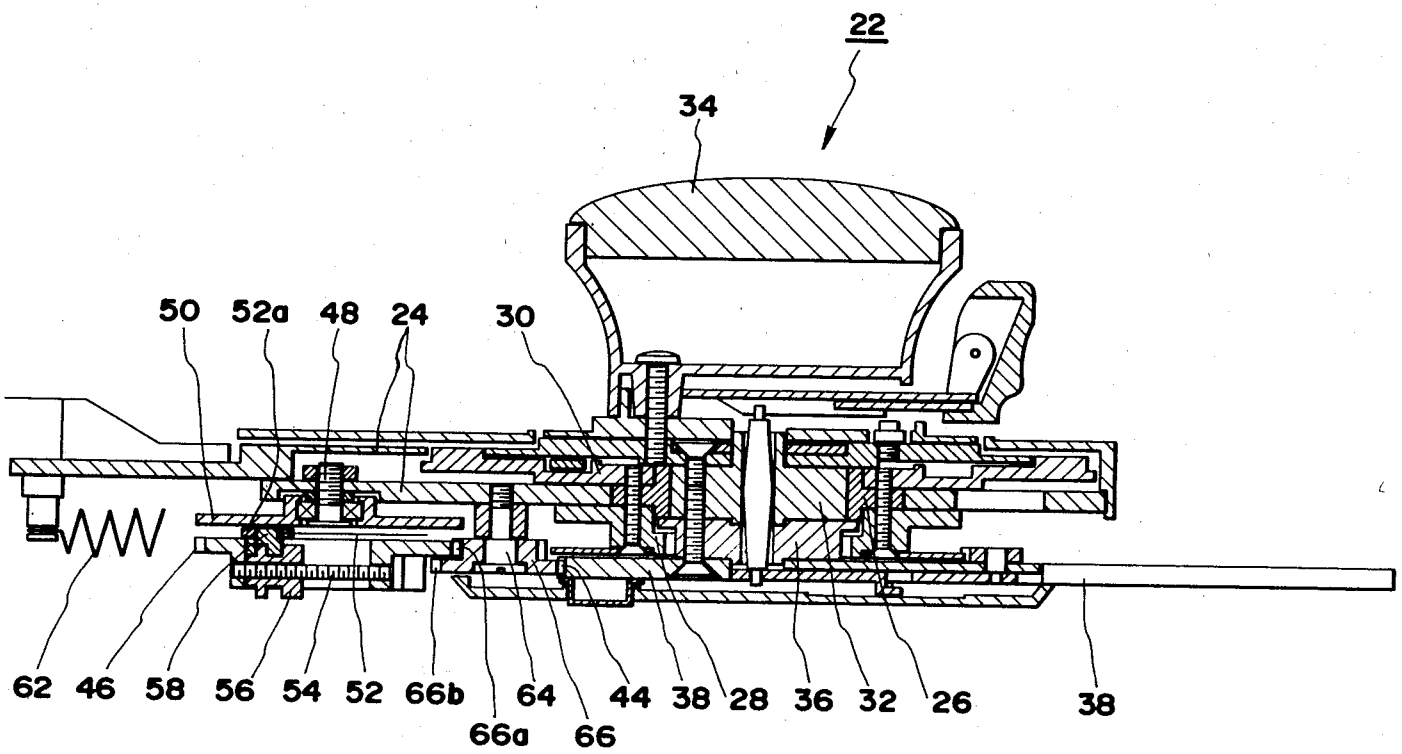
FIG. 1 is a cross section of a head for a universal parallel ruler having a scale balancing device according to the invention.
Figure 2:
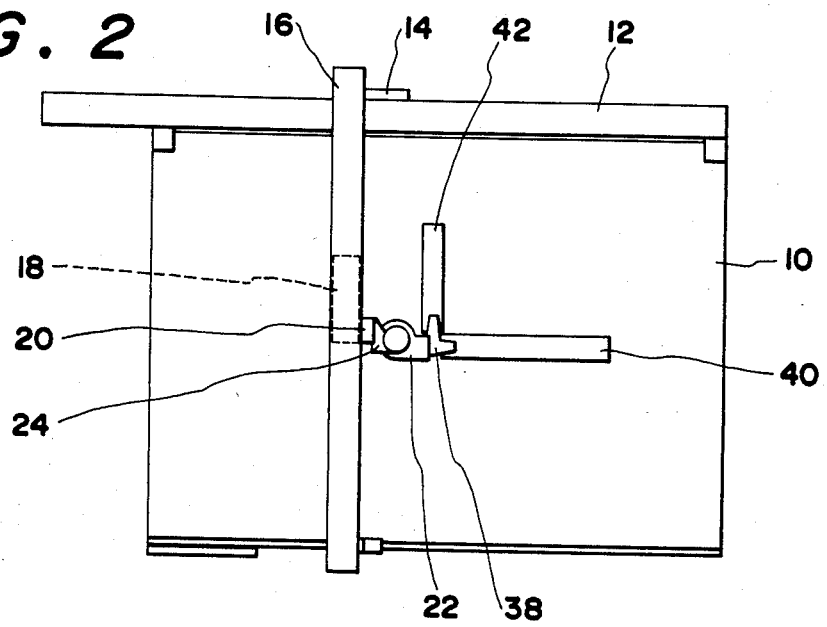
FIG. 2 is an elevation of a universal parallel ruler device.

In FIG. 2, numeral 10 denotes a drawing board, which is fixed to a support frame of a drawing stand (not shown) and capable of tilting and to be fixed at a desired inclined angle between the horizontal and the vertical. Numeral 12 denotes a horizontal rail disposed on the upper side of the drawing board 10, and a horizontal cursor 14 is shiftably mounted on the horizontal rail. The upper end of a vertical rail 16 is connected to the horizontal cursor 14. The lower end of the vertical rail 16 rests on the drawing board 10 by means of a tail portion roller so that it travels freely on the board. Numeral 18 denotes a vertical cursor mounted shiftably on the vertical rail 16, and a support base plate 24 of a head 22 is connected to the vertical cursor by means of a known double hinge mechanism 20. In FIG. 1, numeral 26 denotes a tubular member supported on the support base plate 24, and a tubular spacer 28 and a protractor 30 are fixed to a flange portion of the tubular member 26 by means of screws. The protractor 30 is fixed to the support base plate 24 by a base line brake (not shown) so as to be releasable. Numeral 32 denotes a spindle, and the outer periphery of the spindle 32 is rotatably fitted in the inner periphery of the tubular member 26. On the upper part of the spindle 32, a handle 34 is fixed, and a scale mounting plate 38 is fixed to the lower portion of the spindle 32 by means of a spacer 36. Scales 40 and 42 are fixed to the scale mounting plate 38. A first gear 44 is formed on the scale mounting plate 38 with the spindle 32 as its center of rotation over a range of almost 240 degrees. Numeral 46 denotes a second gear, and the gear 46 is connected to a disc 50 supported on a shaft 48 rotatable on the support base plate 24. A space is provided for a rope 52 between the disc 50 and the gear 46. A bracket formed on the gear 46 has a threaded shaft 54 in a diametral direction of the gear 46, and a knob 56 is threaded on the shaft 54. An element 58 is slidably mounted in a concave groove around the knob 56. The element 58 is guided along a slot in gear 46 which is parallel to the threaded shaft 54, and is shifted during rotation of the knob 56 along the shaft 54. A metal terminal **52*a* connected to one end of the rope 52 is fitted to the element 58. Numeral 60 denotes a guide pulley rotatably journaled on the support base plate 24, and the rope 52 is reeved around the guide pulley 60. The other end of the rope 52 is connected to one end of a spring 62, and the other end of the spring 62 is engaged with a screw fixed to the support base plate 24. Numeral 64 denotes a shaft fixed to the support base plate 24, and an intermediate gear member 66 consisting of two coaxial gears 66*a* and 66*b* is rotatably supported on shaft 64. The small diameter gear 66*a* of the intermediate gear member 66 is meshed with the second gear 46, and the large diameter gear 66*b* is meshed with the first gear 44**.

In this embodiment, if the diameter of the first gear 44 is A, and the diameter of the large diameter gear **66*b* is B, and the diameter of the second gear 46 is C, and the diameter of the small diameter gear 66*a* is D, a formula A:B=C:D is established. The head 22 is so constructed that it can be static at an optional position on the tilting drawing board 10** by a known head balancing device (not shown).

The operation of the embodiment will be described in the following.

Figure 3:
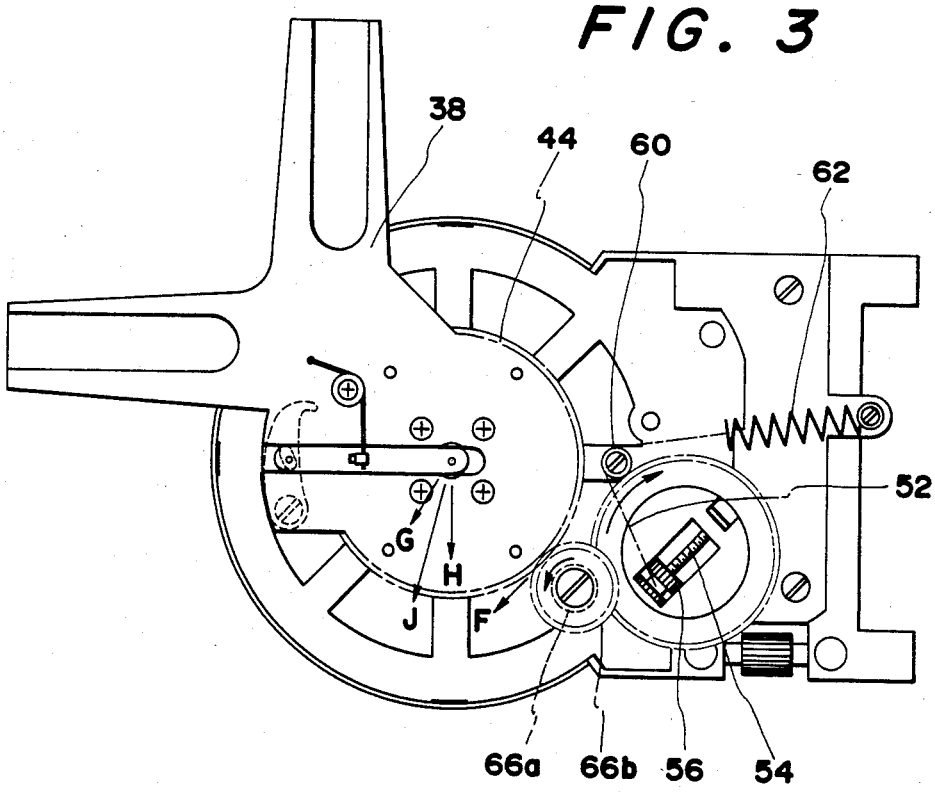
FIG. 3 is a plan of the head of FIG. 1 with a cover removed.
Figure 4:
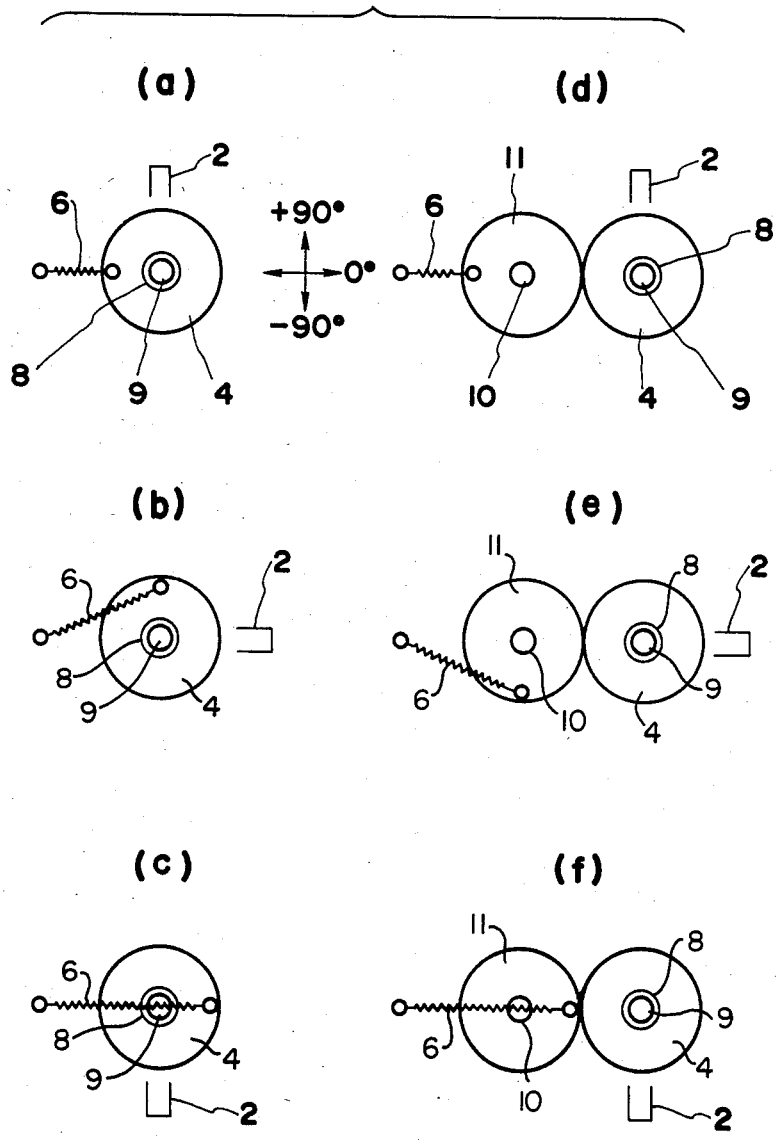
FIGS. 4*a*–4*f* are diagrams for explaining the present invention.

In a condition where the scale mounting plate 38 is released from the support base plate 24, and the scale mounting plate 38 is freely rotatable, when the drawing board 10 is tilted, the scale mounting plate 38 produces a torque E of rotation in a counterclockwise rotating direction in a plane in parallel to the surface of the drawing board 10 in FIG. 3 with the tubular member 26 as its center due to the weight of the scales 40 and 41 and the like. On the other hand, a torque F of rotation is produced in a clockwise rotating direction in FIG. 3 on the second gear 46 by the tensile elastic force of the spring 62, and this torque F of rotation is transmitted as a torque in a clockwise rotating direction to the first gear 44 through the intermediate gear member 66. The rotatory torque due to the weight of the scales 40 and 42 on the first gear 44 and the rotatory torque of the spring 62 are mutually cancelled out because they are in opposite directions, and the scale mounting plate 38 maintains a static stable condition without rapid rotation against the support base plate 24 due to the weight of the scales 40 and 42 on account of the balance.

As described in the foregoing, a ratio A:B of the diameter A of the first gear 44 and the diameter B of the large diameter gear **66*b* is identical with the ratio C:D of the diameter C of the second gear 46 and the diameter D of the small diameter gear 66*a* so that the rotatory angular displacement of the first gear 44 and the rotatory angular displacement of the second gear 46 are identical, and a sine curve of the rotatory torque due to the weight of the scales 40 and 42 on the first gear 44 accompanied by the rotation of the first gear 44 and a sine curve of the rotatory torque accompanied by the rotation of the second gear 46 due to the spring 62 are synchronized. If the sine curve of the rotatory torque of the spring 46 on the second gear 46 is desired to be synchronized with the sine curve of the rotatory torque due to the weight of the scales 40 and 42 on the first gear 44, the diameter of the second gear 46 must be made identical with the diameter of the first gear 44. In this case, when the first gear 44 given a large diameter, the second gear 46 must be given a large diameter accordingly. When the diameter of the first gear 44 is a small diameter, a radius required for the rotatory torque of the gear 44 becomes small so that there exists the necessity of increasing the rotatory torque for balancing of the gear meshed with the first gear 44. The force F for balancing acting on the first gear 44 acts as a reaction force G on the gear 44, as shown in FIG. 3, and the force of the reaction force G and the force H due to the weight of the device such as the scale mounting plate 38 acts between the tubular member 26 and the spindle 32 as a combined force J. This combined force J acts as a frictional force between the spindle 32 and the tubular member 26. In order to make the combined force J small, the diameter of the first gear 44 must be increased. When the diameter of the gear 44 is large, the rotatory torque on the gear 44 by the balancing force F working on the gear 44 can be increased. Accordingly, it is possible to generate the rotatory torque balancing the rotatory torque due to the weight of the scales 40 and 42 on the first gear 44** by a small balancing force F.

Assuming that the tensile force of the spring 62 is F1, and the radius of the first gear 44 is R1, and the radius of the second gear 46 is R2, $$R1 \times F = R2 \times F1$$

Since R2<R1, F<F1. Namely, the spring 62 becomes a strong spring, and also, the amount of its displacement becomes small so that the durability of the spring 62 is improved.

When the angle of inclination of the drawing board 10 is changed, the value of the load W applied at the position of the center of gravity at the scale mounting plate 38 due to the weight of the scales 40 and 42 is accordingly changed. Therefore, when the angle of the drawing board 10 is changed, the amount of eccentricity of the rope 52 relative to the second gear 62 is adjusted by adjusting the rotation of the knob 56, and the magnitude of the rotatory torque of the second gear 62 in the balancing direction is adjusted.

What is claimed is:

1. A scale balancing device for use in a universal parallel ruler device having a head, a spindle rotatably supported on a non-rotating part of the head, a scale mounting plate fixed to a lower portion of the spindle, a handle fixed to the upper portion of the spindle, and scales mounted on the scale mounting plate, said scale balancing device comprising:

a first gear coaxially mounted on said spindle for rotation therewith, the weight of the scales exerting a torque on said first gear;

a second gear rotatably mounted on a non-rotating part of said head and having urging means connected thereto for applying a torque to said second gear to rotate said second gear in a predetermined rotating direction; and a two-stage intermediate gear means having a small diameter gear and a large diameter gear integrally connected and rotatably supported on a non-rotating part of said head, said second gear being in mesh with said small diameter gear and said large diameter gear being in mesh with said first gear, the ratio of the diameter of said first gear to the diameter of said large diameter gear being substantially the same as the ratio of the diameter of said second gear to the diameter of said small diameter gear, and the direction in which the torque is exerted on said first gear due to the weight of the scales being transmitted through said gear means and exerted on said second gear in a direction opposite said predetermined direction and being substantially cancelled out by the torque on said second gear due to said urging means.

* * * * *